US009097035B2

(12) United States Patent
Litwinski

(10) Patent No.: US 9,097,035 B2
(45) Date of Patent: Aug. 4, 2015

(54) KEY FOR A LOCK

(71) Applicant: Artur Litwinski, Warszawa (PL)

(72) Inventor: Artur Litwinski, Warszawa (PL)

( * ) Notice: Subject to any disclaimer, the term of this patent is extended or adjusted under 35 U.S.C. 154(b) by 0 days.

(21) Appl. No.: 14/500,172

(22) Filed: Sep. 29, 2014

(65) Prior Publication Data

US 2015/0089984 A1 Apr. 2, 2015

(30) Foreign Application Priority Data

Sep. 30, 2013 (PL) ..... 405477

(51) Int. Cl.
*E05B 27/00* (2006.01)
*E05B 19/00* (2006.01)

(52) U.S. Cl.
CPC ..... *E05B 19/0035* (2013.01); *Y10T 70/7842* (2015.04)

(58) Field of Classification Search
CPC ..... E05B 27/083; E05B 27/0057; E05B 27/0017; E05B 27/0078; E05B 19/0017; E05B 19/0035; E05B 19/0041; E05B 19/0047
USPC ..... 70/402, 403, 409, 416
See application file for complete search history.

(56) References Cited

U.S. PATENT DOCUMENTS

| | | | | |
|---|---|---|---|---|
| 913,942 | A * | 3/1909 | Bodge | 70/493 |
| 3,348,392 | A * | 10/1967 | Schreiber | 70/358 |
| 3,656,328 | A * | 4/1972 | Hughes | 70/276 |
| 3,659,442 | A * | 5/1972 | Cellini et al. | 70/63 |
| 3,702,549 | A | 11/1972 | Solovieff et al. | |
| 4,012,931 | A * | 3/1977 | Harunari | 70/496 |
| 4,025,740 | A * | 5/1977 | Lipschutz | 200/43.08 |
| 4,289,002 | A * | 9/1981 | Gretler | 70/358 |
| 4,341,102 | A * | 7/1982 | Ku et al. | 70/358 |
| 4,418,555 | A * | 12/1983 | Uyeda | 70/366 |
| 4,841,758 | A * | 6/1989 | Ramblier | 70/276 |
| 5,311,757 | A | 5/1994 | Spahn | |
| 5,428,873 | A * | 7/1995 | Hitchcock et al. | 24/303 |
| 5,613,389 | A * | 3/1997 | Hauser | 70/366 |
| 6,622,538 | B2 * | 9/2003 | Prunbauer et al. | 70/492 |
| 6,758,074 | B1 * | 7/2004 | Prunbauer | 70/366 |
| 6,925,844 | B2 * | 8/2005 | Liu | 70/375 |
| 7,174,757 | B1 * | 2/2007 | Tseng | 70/358 |
| 8,266,937 | B2 * | 9/2012 | Lienau et al. | 70/409 |
| 2004/0172992 | A1 * | 9/2004 | Huang | 70/358 |
| 2013/0091910 | A1 * | 4/2013 | Dolev | 70/406 |
| 2013/0192320 | A1 * | 8/2013 | Dalton et al. | 70/340 |

FOREIGN PATENT DOCUMENTS

| | | | |
|---|---|---|---|
| DE | 817409 | C | 10/1951 |
| EP | 0574752 | A1 | 12/1993 |
| PL | 286075 | A1 | 2/1992 |
| PL | 297946 | A1 | 9/1993 |
| PL | 104466 | A1 | 4/1994 |
| PL | 295989 | A3 | 4/1994 |
| PL | 55805 | Y1 | 2/1998 |
| PL | 195021 | B1 | 8/2007 |

OTHER PUBLICATIONS

Poland Patent Office, Search Report, for Priority Application No. PL 05 477, dated Oct. 30, 2013.

* cited by examiner

*Primary Examiner* — Suzanne Barrett
(74) *Attorney, Agent, or Firm* — Walker & Jacke

(57) ABSTRACT

A key (1) for operating a lock such as a door lock or padlock, includes a grip portion (2) and a cylindrical shank (3). The shank includes an abutment (4) that extends radially to position the key in the lock and transfer driving force from the key to the lock mechanism. The key includes encoding recesses (5) that cooperate with elements for unlocking the lock, such as pins. In cross-section at least part of each encoding recess has a substantially triangular shape with a truncated vertex.

20 Claims, 2 Drawing Sheets

KEY FOR A LOCK

The invention provides a key for a lock to activate such lock as for example door locks or padlocks.

From the application P 297946 a flat key is known with a basic shaped part made of metal which forms a shank segment and a grip segment. In the recess in the grip segment, formed by integral bottom of the basic shaped part, a plate is placed, said plate being provided with constructive parts of an electronic link and sealed by a pourable sealing compound. At the opposite flat sides of the grip segment there are positioned enclosure shells which substantially entirely encircle the grip segment. The enclosure shell overlaying the recess is adhered to the grip segment by means of a glue seam that sealingly encircles the recess. The other enclosure coat comprises a rib of a U-shape in a view towards the flat side, by means of which it catches the adhered enclosure shell. A tubular rivet extending not only through the enclosure shells but also through a segment of the grip, fixedly secures the enclosure shell in the longitudinal direction set on the adhered enclosure shell on the basic shaped part and at the same time protects the hole for the key ring. In order to receive a plate with indicia in the adhered enclosure shell, a trapezoidal groove is provided, opened towards its edge, the open leading sides of which are closed by ribs of the second enclosure shell.

In the prior art there are known, for example from the Polish patent PL 195021, flat keys that have a shank of a flat key and at both its flat surfaces they have a longitudinal profile provided with grooves and/or longitudinal ribs, and at the segment of the top profile that is narrower than the shank at least one cutout of the key is made on its web, used to control the shank gate, and the outline of the top profile is outside the outline of the shank profile.

From the Polish patent application P 295989 a key is known for operating mechanisms of locks and bolts, in a cylindrical shape, having on its operational surface an abutment to secure the position of the key within the lock or bolt mechanism and to transfer driving force from the key to the lock or bolt mechanism. Moreover, the key has on its cylindrical shank recesses used to unlock the lock or bolt mechanism. The ratio of the outer and inner diameters of the cylindrical lock is included within a range of 2 to 1.5, preferably 8 to 5.

Utility model specification PL 55805 discloses a key for operating locks and bolts, comprising a grip portion and an operational shank on the outer cylindrical surface of which an abutment is positioned to secure the position of the key within the lock or bolt mechanism and to transfer driving force from the key to the lock or bolt mechanism, and there are provided recesses used to unlock the lock or bolt mechanism, where the ratio of the outer diameter of the cylindrically shaped operational shank to the inner diameter is 8:5.1.

A key for a lock according to this invention comprises a grip portion and a cylindrical operational shank on the outer surface of which an abutment is positioned radially to the axis that secures the position of the key within the lock mechanism and transfers driving force from the key to the lock mechanism, and on the cylindrical key surface encoding recesses are provided that cooperate with elements for unlocking the lock mechanism, such as pins. In the cross-section of the operational shank and the encoding recesses, at least a part of the encoding recesses have a substantially triangular shape with a truncated vertex towards the axis of the operational shank of the key.

Preferably, all the encoding recesses have a substantially triangular shape with a truncated vertex towards the axis of the operational shank of the key.

Also preferably, the abutment of the operational shank is placed between the grip portion of the key and the operational shank portion with encoding recesses.

The advantage of the solution according to the invention, consisting on a change in the shape of encoding recesses, when compared to the prior art, is provision of a possibility to duplicate keys on existing versatile machinery intended for operations of this kind. The mode of operation and use of the key remains the same, but a consequence of the change is a larger accessibility of duplication services in case of lost or damage of keys.

BRIEF DESCRIPTION OF THE DRAWINGS

The object of the invention is shown in embodiments in the drawing, where.

DETAILED DESCRIPTION

Figure 1:
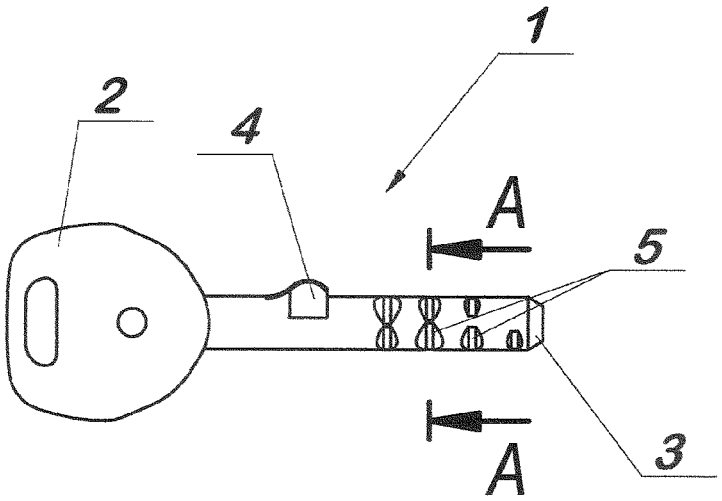
FIG. 1 shows a side view of a key according to the invention.

As shown in FIG. 1, a key 1 for a lock mechanism comprises a grip portion 2 and a cylindrical operational shank 3 having an outer diameter D, and on the outer surface of the shank an abutment 4 is provided. The abutment is made by pressing from the cylindrical surface of the operational shank 3 and it secures the position of the key 1 in the lock mechanism and transfers driving force from the key 1 to the lock mechanism. The shank of the key has on the cylindrical surface encoding recesses 5 that cooperate with elements for unlocking the lock mechanism, such as pins.

Figure 3:
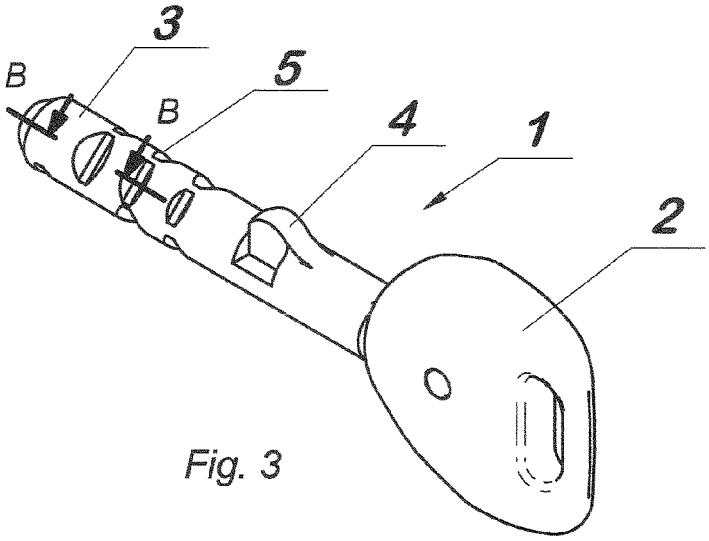
FIG. 3 shows a key in a perspective view from the grip portion side.
Figure 4:
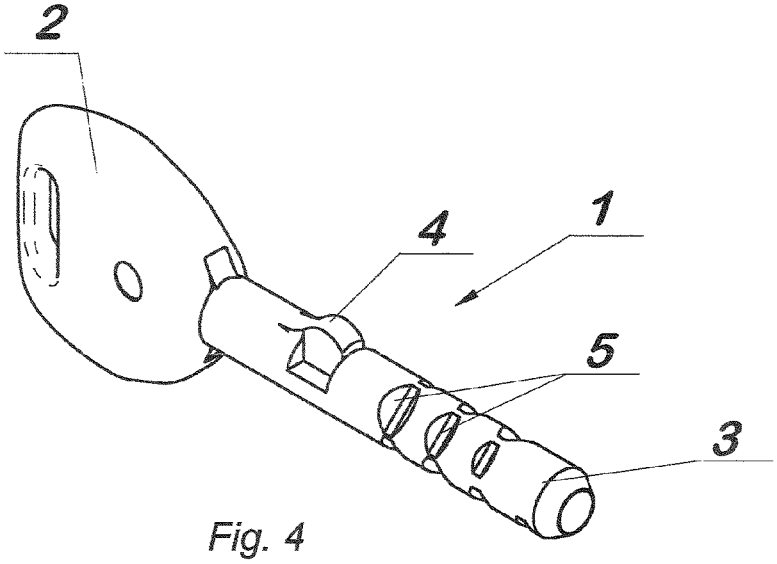
FIG. 4 shows a key in a perspective view from the operational shank side.

The embodiment shown in FIGS. 1, 3 and 4 is a key 1 that has in its outer surface of the operational shank 3 encoding recesses 5 the shape of which in a longitudinal section of the operational shank 3 of the key is substantially triangular with a truncated vertex towards the axis of the operational shank 3 of the key 1.

Figure 2:
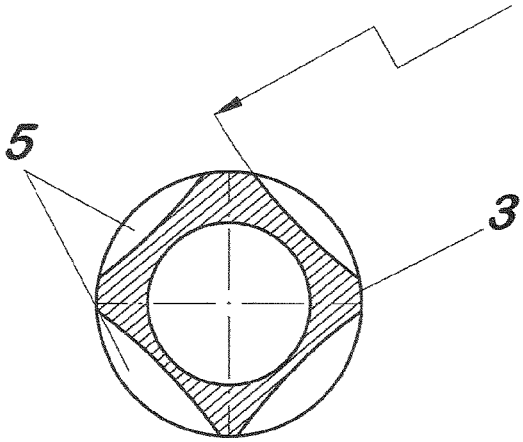
FIG. 2 shows a key in cross-section along line A-A of FIG. 1.

FIG. 2 shows in a longitudinal section along line A-A of FIG. 1 an operational shank 3 with cut out encoding recesses 5. As it may be seen, they have in this section a shape of a circular segment of a long radium when compared to the shank diameter. This shape results from the use, for making encoding recesses 5, of a tool in a form of a disc having in its cross-section an outer periphery in a shape of a triangle with a truncated vertex.

Figure 5:
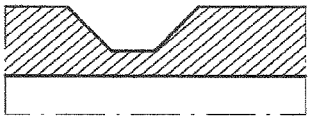
FIG. 5 shows a key in cross-section along its longitudinal axis and through the center of symmetry of encoding recesses along line B-B of FIG. 3.

FIG. 5 shows, in a section along line B-B of FIG. 3, the shape of the encoding recesses 5 made by means of such a tool.

FIGS. 3 and 4 show, in a perspective view, a key 1 with encoding recesses 5 according to the invention, from the grip portion 5 side and from the opposite side.

I claim:

1. A key configured for use with a lock, wherein the key is usable to change the lock between a locked condition and an unlocked condition, the key comprising:

a grip portion and a shank portion, wherein the grip portion is configured to be manually gripped and rotated, wherein the shank portion extends outwardly relative to the grip portion along an axis, and wherein the shank portion includes a generally cylindrical outer surface, and an abutment, wherein the abutment extends generally radially outward relative to the axis, wherein the abutment extends radially outward from less than an entire circumference of the generally cylindrical outer surface, wherein the abutment is configured to transmit rotational motion of the key about the axis and cause movement of at least one mechanism of the lock, wherein the shank portion includes a plurality of encoding recesses, wherein each of the encoding recesses is configured to be in cooperative engaging relation with respective elements of the lock, wherein in cross-section coplanar with such axis, each encoding recess includes a generally inward directed triangular shape having a truncated vertex, wherein the truncated vertex is radially disposed outward from the axis.

2. The key according to claim 1 wherein in axial cross section coplanar with the axis, each encoding recess includes a radially inwardly directed triangular shape, and wherein each encoding recess extends inward from the generally cylindrical outer surface on less than one-fourth of the entire circumference.

3. The key according to claim 2 wherein the abutment is disposed axially intermediate of the grip portion and an encoding recess disposed on the shank portion axially closest to the grip portion.

4. The key according to claim 3 wherein the key includes a plurality of encoding recesses disposed at a plurality of different axial distances from the grip portion.

5. The key according to claim 4 wherein the key includes a plurality of encoding recesses disposed at a common axial distance from the grip portion.

6. The key according to claim 5 wherein the generally cylindrical outer surface of the shank portion includes a shank diameter, wherein in cross-section perpendicular to the axis, each engaging recess includes a circular segment that has a radius relatively longer than the shank diameter.

7. The key according to claim 6 wherein the truncated vertex of each encoding recess is radially disposed outwardly from the axis.

8. The key according to claim 7 wherein at least one encoding recess is bounded radially inwardly by an inward surface, wherein the inward surface includes the truncated vertex, and wherein the inward surface includes an arcuate surface.

9. The key according to claim 8 wherein the abutment includes a radially outward extending projection produced by the shank portion having been pressed.

10. The key according to claim 1 wherein the abutment is disposed on the shank portion a first axial distance from the grip portion, and wherein a first encoding recess disposed on the shank portion axially closest to the grip portion is disposed a second axial distance from the grip portion, wherein the second axial distance is greater than the first axial distance.

11. The key according to claim 1 wherein the key includes a plurality of encoding recesses disposed at a common axial distance from the grip portion.

12. The key according to claim 1 wherein the generally cylindrical outer surface of the shank portion includes a shank diameter, wherein in cross-section perpendicular to the axis, each encoding recess includes a circular segment that has a radius relatively longer than the shank diameter.

13. The key according to claim 1 wherein the truncated vertex of each encoding recess is radially disposed outwardly from the axis.

14. The key according to claim 1 wherein at least one encoding recess is bounded radially inwardly by an inward surface, wherein the inward surface includes the truncated vertex, and wherein the inward surface includes an arcuate surface.

15. The key according to claim 1 wherein the abutment includes a radially outward extending projection produced by the shank portion having been pressed.

16. A key configured to be used with a lock and usable to change the lock between a locked condition and an unlocked condition, comprising:

a grip configured to be manually engaged and rotated, a shank, wherein the shank is in operative connection with the grip, extends away from the grip along an axis, is bounded by a generally cylindrical outer surface, includes an abutment, wherein the abutment extends radially outward relative to the axis and from the generally cylindrical outer surface about less than an entire circumference of the cylindrical outer surface, is configured to operatively engage and move a mechanism of the lock, includes a plurality of encoding recesses, wherein the encoding recesses are disposed on the shank at at least one axial distance away from the grip, and wherein each encoding recess is configured to be in cooperative relation with a respective element of the lock, and wherein in cross-section coplanar of the axis, each encoding recess includes a radially inward extending triangular shape with a truncated vertex that is radially disposed outwardly from the axis.

17. The key according to claim 16 wherein encoding recesses are disposed at different axial distances from the grip, and wherein each encoding recess extends inward from the outer surface on less than one-fourth of the entire circumference.

18. The key according to claim 16 wherein a plurality of encoding recesses are disposed on the shank at a common axial distance from the grip.

19. The key according to claim 16 wherein the abutment is disposed axially intermediate of the grip and an encoding recess disposed on the shank axially closest to the grip.

20. A key configured to be usable with a lock and to change the lock from a locked condition to an unlocked condition responsive to rotational movement of the key, comprising:

a grip, wherein the grip is configured to be manually engageable and rotatable, a shank, wherein the shank is in operative connection with the grip and is rotatable therewith, wherein the shank includes a generally cylindrical outer surface that extends coaxially about an axis, wherein the shank includes an abutment that extends radially outward relative to the axis and from a portion of the cylindrical surface, wherein the abutment is configured to engage and move a mechanism of the lock upon rotation of the shank when in engagement with the lock, wherein the shank includes a plurality of encoding recesses, wherein each of the encoding recesses is configured to cooperate with a respective element of the lock, wherein the encoding recesses are disposed at a plurality of different axial distances away from the grip, and wherein at least two encoding recesses are disposed in different circumferential portions of the outer surface at the same axial distance from the grip, wherein each of the plurality of encoding recesses in cross-section coplanar of the axis includes an inward directed triangular shape with a truncated vertex.

* * * * *